US006955180B2

(12) United States Patent
Kocherlakota et al.

(10) Patent No.: US 6,955,180 B2
(45) Date of Patent: Oct. 18, 2005

(54) PIPETTE WASHER

(75) Inventors: Nirmala Kocherlakota, Metuchen, NJ (US); Laszlo Ernyei, Langhorne, PA (US)

(73) Assignee: Spex Certiprep, Inc., Metuchen, NJ (US)

( * ) Notice: Subject to any disclaimer, the term of this patent is extended or adjusted under 35 U.S.C. 154(b) by 45 days.

(21) Appl. No.: 10/336,866

(22) Filed: Jan. 6, 2003

(65) Prior Publication Data

US 2004/0129299 A1 Jul. 8, 2004

(51) Int. Cl.[7] ..... B08B 3/04

(52) U.S. Cl. ..... 134/169 C; 134/171; 134/186; 422/300; 422/297

(58) Field of Search ..... 422/300, 303, 422/302, 297; 134/166 C, 169 C, 170, 171, 186, 155, 198

(56) References Cited

U.S. PATENT DOCUMENTS 1,400,797 A * 12/1921 Burnham ..... 134/167 R
1,757,035 A * 5/1930 Beckman ..... 134/88
1,946,400 A * 2/1934 Hapgood ..... 134/171
2,162,228 A * 6/1939 Peirce ..... 422/303
2,222,675 A * 11/1940 Lynger ..... 15/418
2,519,654 A * 8/1950 Heaney ..... 134/103.1
2,536,695 A * 1/1951 Ratner ..... 134/171
2,786,479 A * 3/1957 Dungfelder et al. ..... 134/72
2,786,480 A * 3/1957 Hofer ..... 134/171
2,811,975 A * 11/1957 Tatibana ..... 134/102.1
2,877,777 A * 3/1959 Walter ..... 134/23
3,070,104 A * 12/1962 Faust et al. ..... 134/145
3,629,005 A * 12/1971 Belden ..... 134/171
3,638,666 A * 2/1972 Fishman ..... 134/57 R
4,345,609 A * 8/1982 Nishizawa ..... 134/57 R
4,354,514 A * 10/1982 Sundheimer et al. ..... 134/152
4,406,297 A * 9/1983 Walton ..... 134/102.3
4,708,153 A * 11/1987 Hambleton et al. ..... 134/170
4,854,336 A * 8/1989 Byzitter ..... 134/104.1
5,120,512 A * 6/1992 Masuda ..... 422/297
5,505,218 A * 4/1996 Steinhauser et al. ..... 134/95.1
5,592,959 A * 1/1997 Nagai ..... 134/169 R
5,749,385 A * 5/1998 Rochette et al. ..... 134/199
6,422,248 B1 * 7/2002 Furst et al. ..... 134/22.11

* cited by examiner

*Primary Examiner*—Frankie L. Stinson
(74) *Attorney, Agent, or Firm*—Kirkpatrick & Lockhart Nicholson Graham LLP

(57) ABSTRACT

A pipette washer comprising a plurality of cells for receiving pipettes is disclosed. Each of the cells comprises a top opening for receiving pipettes to be washed and a bottom opening. A support member supports the cells with the top opening accessible to receive pipettes to be washed. A hose system is coupled to the bottom opening on the cells. A supply hose is connected to the hose system. Each of the cells is supported in the support member with an orientation extending transverse to the horizontal. Each of the support cells comprises a cell member having a top width and a bottom width. The width is wider at the top and narrower at the bottom. In accordance with the preferred embodiment, each cell member is conical in shape. A housing contains and rechannels washing liquid while at the same time having an open front to allow for convenient access to the cells.

21 Claims, 4 Drawing Sheets

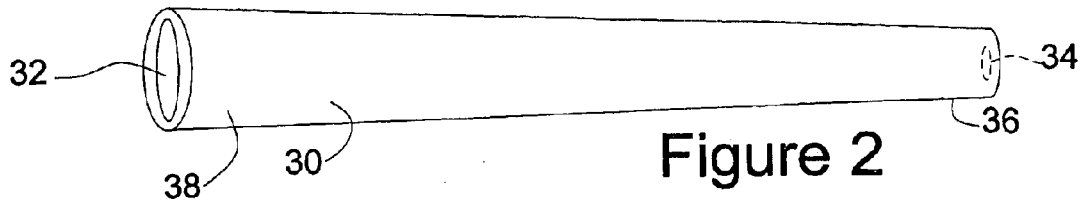
Figure 2
Figure 3
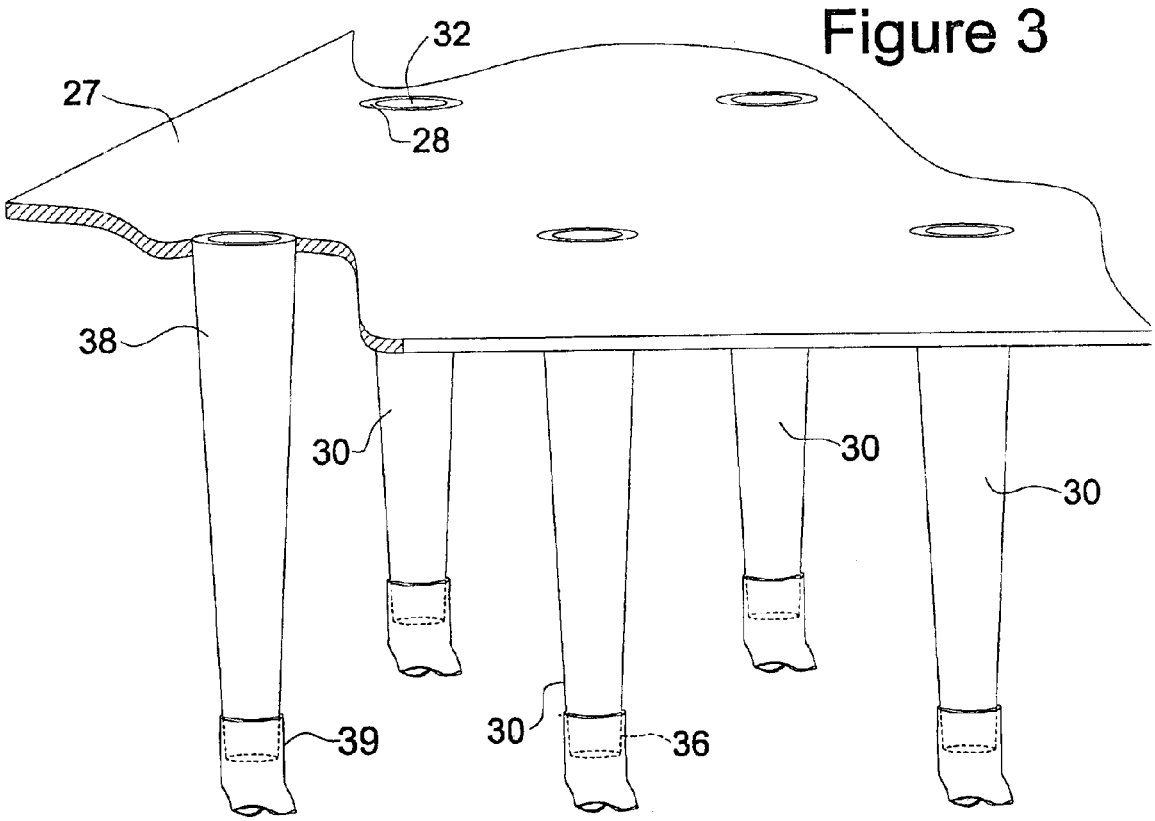

PIPETTE WASHER

TECHNICAL FIELD

The present invention relates to the field of washing devices.

BACKGROUND OF THE INVENTION

Many measurement tasks involve the volumetric measurement of materials in liquid form. Such volumetric measurements may include measuring the amount of liquid taken from, for example, a lake, reservoir or other body of water which one wishes to test for environmental pollutants. In other applications, assembly line testing of samples may require reactants to be dispensed for use in a testing procedure. In similar fashion, manufacturing processes may require the input of measured amounts of reactants into a vessel in which a reaction, mixing, or other operation is being carried out.

Typically, relatively small measured quantities of liquids are removed from a larger quantity of liquid using a pipette. Pipettes generally come in two forms. Some pipettes comprise elongated tubes which have a volume which is at least somewhat larger than the volume of liquid which they are meant to remove. Such pipettes have an inlet tip at one end and an open port at the other end. Typically, the inlet tip of such a pipette is dipped into the source of the liquid which one wishes to measurably remove. By vacuum the liquid is drawn into the pipette up to a level marked by a graduation which is usually etched into or printed on the pipette. Generally, the volume between the inlet tip of the pipette and the graduation is the volume which the pipette is designed to sample or otherwise measurably remove. The open port at the other end of the pipette is then sealed in an airtight fashion. The pipette is then removed from the source of the liquid which one is sampling, and because of the relatively narrow diameter of the opening at the inlet tip of the pipette, the combined forces of air pressure acting at the interface of the atmosphere and the liquid being sampled and cohesive forces within the liquid being sampled act to prevent the liquid being sampled from flowing out the bottom of the pipette through the inlet tip of the pipette. Next, the pipette is placed over the vessel which is to receive the sampled liquid, the airtight seal at the port is opened, and the liquid in the pipette flows out the inlet tip of the pipette into the vessel which is to receive the liquid being sampled.

Airtight sealing of the open port of the pipette may be achieved simply by using a finger to tightly seal the open port. Alternatively, a pipette may be provided with a rubber bladder, which may be squeezed and then slowly released to allow the input of liquid up to the graduation. After this, the bladder may be depressed again to release the liquid being sampled.

While some pipettes simply comprise straight tubes, where large volumes of material are to be measurably removed, pipettes generally comprise a tube with a central area which comprises an enlarged bulbous portion. Both pipettes with and without a bulb may include either a single graduation if they are to be used to measure a single volume, or a plurality of graduations if they are to be used to measure a plurality of different volumes.

Typically, pipettes are used over and over again. Accordingly, if a pipette is being used for one material then another material, it is usually necessary to wash the pipette. Likewise, even if a pipette is being used only for a single material, if it is to lie unused for a period of time, material remaining on the pipette may react, dry out, or otherwise change, thus making it undesirable to leave a used pipette unwashed. Accordingly, pipettes are constantly being washed. It will be appreciated that pipettes must be washed both on the inside and the outside, although the challenge to obtain a well cleaned pipette is the thorough cleaning of the inside of the pipette.

Washing is complicated due to the narrow inner diameter of pipettes and the relatively inaccessible surfaces of bulbs on large volume pipettes. Accordingly, it is important that washing be carried out easily and thoroughly, as delay will often only make the washing operation more time-consuming and difficult to achieve with thoroughness.

SUMMARY OF THE INVENTION

In accordance with the invention, a machine is provided to wash pipettes. Special internal structure is provided to achieve the thorough cleaning of pipettes. In addition, the structure also provides for the quick placement of pipettes into the inventive washer apparatus and for their easy removal. At the same time, convenience is provided by making it unnecessary to open and close the washer in order to clean pipettes. In addition, the structure of the inventive pipette washer provides for thorough cleaning of the inside and outside of the pipette.

In addition, the inventive pipette cleaner is of relatively shallow construction, thus allowing it to be placed against the back of a sink, and for allowing the inventive washer to take up a minimum amount of sink space, floor space or counterspace.

In accordance with the invention, a washer is provided which comprises an open washing chamber. A rack for supporting a plurality of pipettes to be washed is located near the bottom of the washing chamber. The rack includes a plurality of pipette receiving cells. In accordance with the preferred embodiment, the cells are wider at the top than they are at the bottom. In accordance with the preferred embodiment, the cells support pipettes to be cleaned in a generally upright, though not necessarily vertical orientation, with the pipette tip at the top. Such functions are provided in accordance with the invention with a generally funnel-shaped cell, for example with an inverted conical shape.

Each of the cells is open at the bottom and at the top. The opening at the top of the cell is large enough to easily and quickly accommodate a pipette, inlet tip extending upwardly. The opening at the bottom of the cell is small enough to prevent the other end of the pipette from falling through the bottom of the cell, and, optionally and preferably, small enough to prevent the inlet end of the pipette from falling through the bottom of the cell.

In accordance with the invention, the portion of the cell between the top and the bottom is configured to guide pipettes toward the bottom opening at the bottom of the cell, to place the relatively large open port at the end of the pipette over the bottom opening at the bottom of the cell.

The inventive pipette washer further comprises at least one, and preferably a plurality of compartments, each of which is fed by a water supply line. If desired, cells may be segregated into groups and each group may have a common water supply line which may be turned on only when one or more cells in the group are being used to wash a pipette or a plurality of pipettes resting within cells in the group.

More particularly, in accordance with the invention, a pipette washer comprises a plurality of cells for receiving pipettes. Each of the cells comprises a top opening for receiving pipettes to be washed and a bottom opening. A support member supports the cells with the top opening accessible to receive pipettes to be washed. A hose system is coupled to the bottom opening on the cells. A supply hose is connected to the hose system. Each of the cells is supported in the support member with an orientation extending transverse to the horizontal. Each of the support cells comprises a cell member having a top width and a bottom width. The width is wider at the top and narrower at the bottom. In accordance with the preferred embodiment, each cell member is conical in shape.

A metering device may be employed in accordance with the invention to have a quantity of a cleanser material in a fluid being supplied through the supply hose. The system may further comprise a fluidic switch having a plurality of inputs and an output, the output being coupled to the supply hose. If desired, and accordance with the invention, a vacuum may be connected to one of the fluidic switch inputs.

The fluidic switch may be connected to a source of washing fluid and a vacuum. The fluid switch is controlled by a control circuit which causes washing fluid to the supplied to the supply hose for a first period of time. The control circuit also causes the fluidic switch to take a position which allows for the drainage of washing fluid during a second period of time, the second period of time occurring after the first period of time. The control circuit causes the fluidic switch after the second period of time to take another position where the fluid switch is coupled to the vacuum to allow for the drying of pipettes in the cells by drawing air in through the pipette tip.

If desired, the cells may be organized into gangs, with each of the gangs being connectable as a group to the supply hose.

BRIEF DESCRIPTION OF THE DRAWINGS

These and other objects of the invention will be understood from the following description taken in conjunction with the drawings, which illustrate only a number of embodiments of the invention, and in which:

FIG. 2 is a detail of a pipette receiving cell useful in the washer illustrated in FIG. 1;

FIG. 3 is a detailed partially cutaway view in perspective of the inventive washer illustrated in FIG. 1, illustrating a plurality of pipette receiving cells mounted in a support rack;

DETAILED DESCRIPTION OF THE PREFERRED EMBODIMENTS

Figure 1:
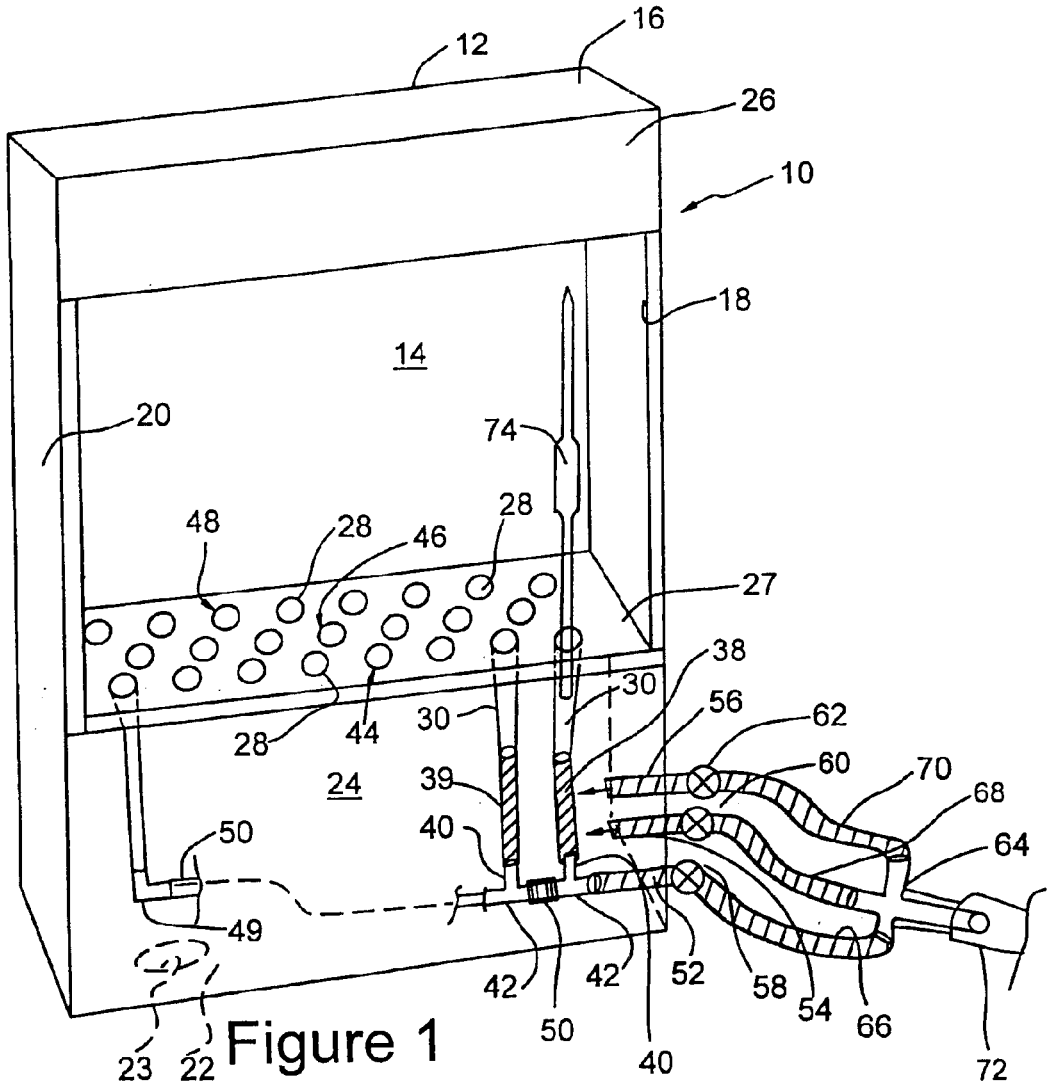
FIG. 1 is a perspective view of a washer constructed in accordance with the present invention.

A pipette washer 10 constructed in accordance with the present invention is illustrated in perspective in FIG. 1. The pipette washer 10 comprises a housing 12. Housing 14 comprises a back panel 14, a top panel 16, and a pair of side panels 18 and 20. Housing 14 further comprises a bottom panel 22 defining a drain hole 23, a lower front panel 24, and an upper front panel 26.

In accordance with the invention, a support rack 27 includes twenty-three circular holes 28. The various housing members are secured to each other and to support rack 27 using glue or other suitable means. Each circular hole 28 receives a pipette support cell 30, only two of which are illustrated in FIG. 1 for purposes of clarity of illustration. As illustrated in FIG. 2, support cells 30 have a generally tapered or conical shape and, for economical reasons may be made from plastic pipette tips which are available on the market from numerous suppliers. Each pipette support cell 30 has an upper opening 32 having an inner diameter of 1.27 cm, and a lower opening 34, a small end 36, having an inner diameter of 63.5 mm. Pipette support cells 30 have a length of approximately 10.16 cm.

Support cells 30 are mounted in holes 28 in support rack 27, as illustrated in FIG. 3. The large end 38 of each support cell 30 is mounted in its respective hole 28. Each support cell 30 is maintained in position in its respective hole 28 using glue in accordance with the preferred embodiment. The small end 36 of each support cell 30 receives a length 38 of tubing as illustrated in FIGS. 1 and 3. Referring to FIG. 1, each of the lengths 38 of tubing leads to the central branch 40 of a T-connector 42. As can be seen in FIG. 1, support cells are grouped into three rows 44, 46 and 48. All of the support cells 20 in a given row are connected together by a line formed by a plurality of T-connectors 42 and a terminal elbow 48 which are joined together by a plurality of short lengths 50 of tubing. The result is three gangs of support cells 30 corresponding to the three rows 44, 46 and 48 formed by holes 28.

Each gang of support cells 30 is connected by a respective length 52, 54 and 56 of tubing to a respective valve 58, 60 and 62. Valves 58, 60 and 62 are connected to a four-way connector 64 by a plurality of lengths 66, 68 and 70 of tubing. Four way connector 64 is in turn, connected to a source of purified water, such as deionized water by a length 72 of tubing.

In use, pipette washer 10 is placed in a sink to provide for removal of water. A pipette 74 is placed in a support cell 30, perhaps after being rinsed with ordinary tap water, depending upon the material which is to be washed from the pipette 74. If the pipette is of the type incorporating a rubber ball or bladder, the bladder is removed before washing. In accordance with the invention, pipettes may be placed in all or some of the support cells. However, it is contemplated that if a limited number of pipettes are being washed, they will all be placed in a single gang, and valves 58–62 adjusted to insure that only the gang with pipettes in it is fed with water. For example, if pipettes have only been placed in row 44, valve 58 would be open to allow a cleaning fluid to enter, while valves 60 and 62 would be closed.

After the pipettes are placed in their respective support cells 30, water, for example, from the tap or a deionized water source or another cleaning fluid is caused to enter tube 72, causing liquid to enter each of the support cells 30, in the instant example limited to the support cells 30 in row 44.

When water is fed to the inventive washer, liquid enters the bottom of each support cell 30 and travels up the inside of each pipette 74. Depending upon the pressure of the water source, the number of pipettes in the support cells, the size of the pipettes, and the number of support cells being provided with water, water may simply exit the top of the pipette at low speed and dribble down over the outside of the pipette. On the other hand, if water is projecting with greater force, water will project from the tip of the pipette at high speed and hit the bottom side of top panel 16 and and rain down on the pipettes to clean the outsides of the pipettes being cleaned. This results in cleaning the outside and inside of the pipettes. Excess water accumulating in washer 10 escapes through drain hole 23. Alternatively, washer 10 may be bottomless.

In accordance with the invention, after flushing with the ionized water has been done, water is allowed to flow away from the pipettes by disconnection of hose 72, and a vacuum may then be optionally connected in place of the water supply to dry the pipettes.

It will be appreciated from the above description that the front side of the inventive washer 10 is open, thus making it very convenient to insert and remove pipettes for washing.

Figure 4:
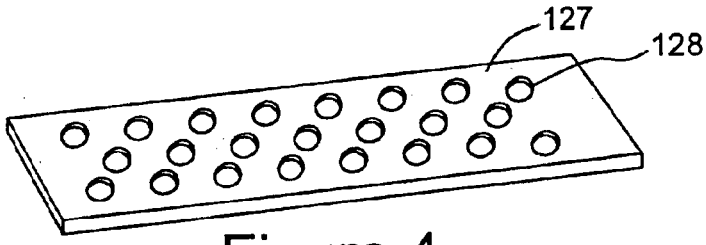
FIG. 4 is a plan view of a support rack in accordance with an alternative embodiment of the invention.

An alternative embodiment of the invention is illustrated in FIG. 4. In the embodiments whose description follows below, parts performing similar or analogous functions have been given numbers which vary by multiples of 100 as compared to analogous parts in the above described embodiment.

An alternative embodiment of the invention is illustrated in FIG. 4. In this case, panel 127 has a row with a limited number of holes 128. The purpose of limiting the number of holes 128 is to accommodate the washing of a relatively small number of pipettes. If desired, gangs having 1, 3, 5, 12, 25 or other number of holes may be employed depending upon the application. Moreover, users may rearrange and vary the size and location of the gangs as desired because of the use of flexible hose 50, which is not necessarily glued to the respective connectors. Moreover, and in accordance with the present invention, gangs of any number of holes whether in the form of rows or otherwise may be color-coded to make them visually identifiable. Suitable hose for use in the present invention is Tygon hose sold by the Norton Company of Worcester Mass.

Figure 5:
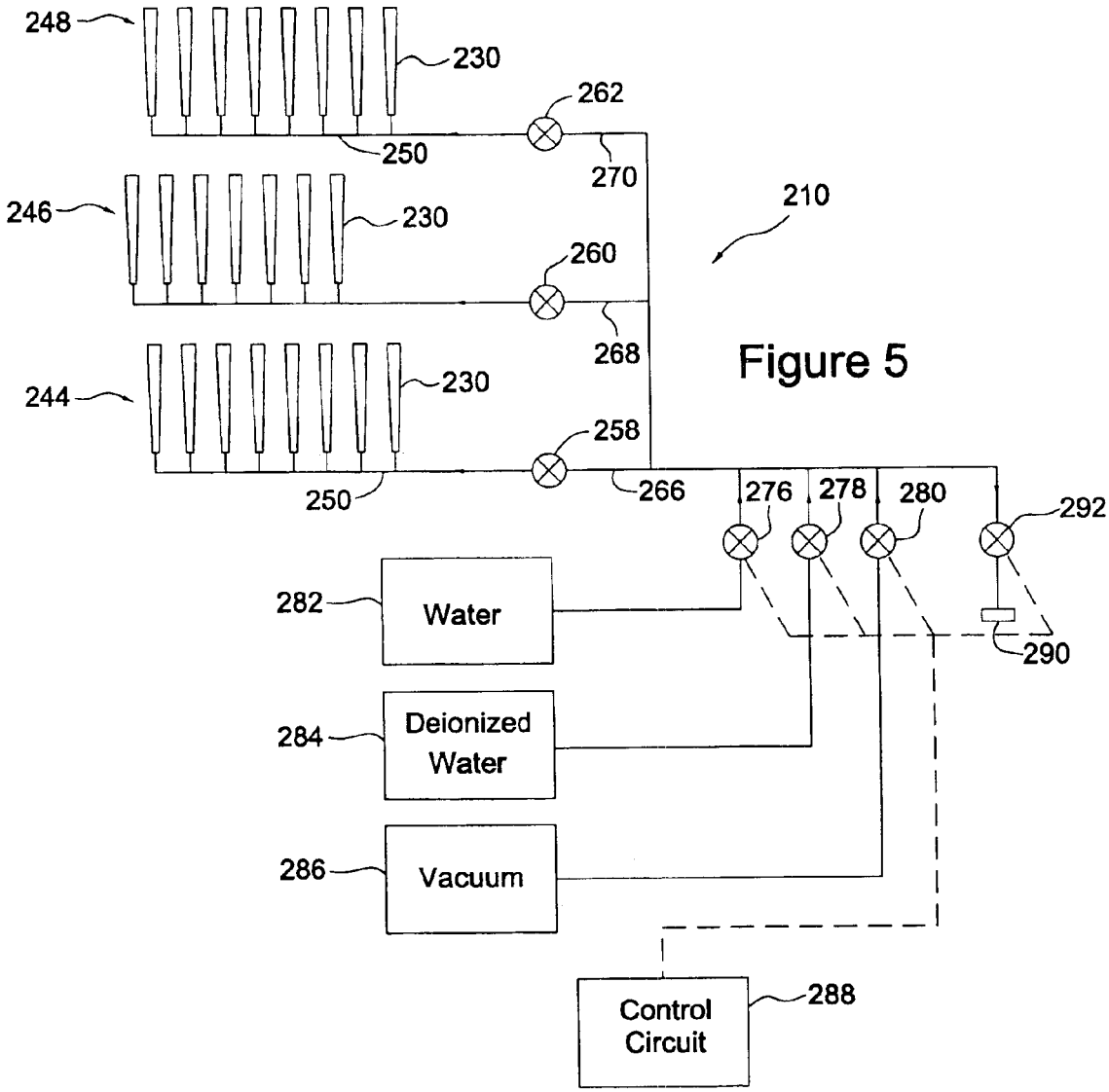
FIG. 5 is a schematic diagram of another alternative embodiment of the inventive pipette washer.

An alternative embodiment of the inventive pipette washer 210 is illustrated in FIG. 5. In accordance with this embodiment, a plurality of rows 244, 246 and 248 of support cells 230 are connected by lines 250 to valves 258, 260 and 262. The rows are in turn connected by lines 266, 268 and 270 to a plurality of control valves 276, 278 and 280. Valve 276 connects the system to a water source 282, which may be ordinary tap water. Valve 278 connects the system to a de-ionized water source 284. Valve 280 connects the system to a vacuum 286. Finally, a drain 290 may be connected to cells 230 through a valve 292.

During use, control circuit 288 controls the system, initially opening only valve 276 to flush the pipettes in cells 230 with water. Next, valve 276 is closed and valve 278 is opened by control circuit 288 to flush the pipettes with de-ionized water from source 284. Next, valve 278 is closed and valve 292 is opened by control circuit 288, allowing water in the system to drain into drain 290. Finally, valve 292 is closed and valve 280 is opened by control circuit 288, to apply a vacuum to the active gang or gangs of cells 230 and dry the pipettes.

Figure 6:
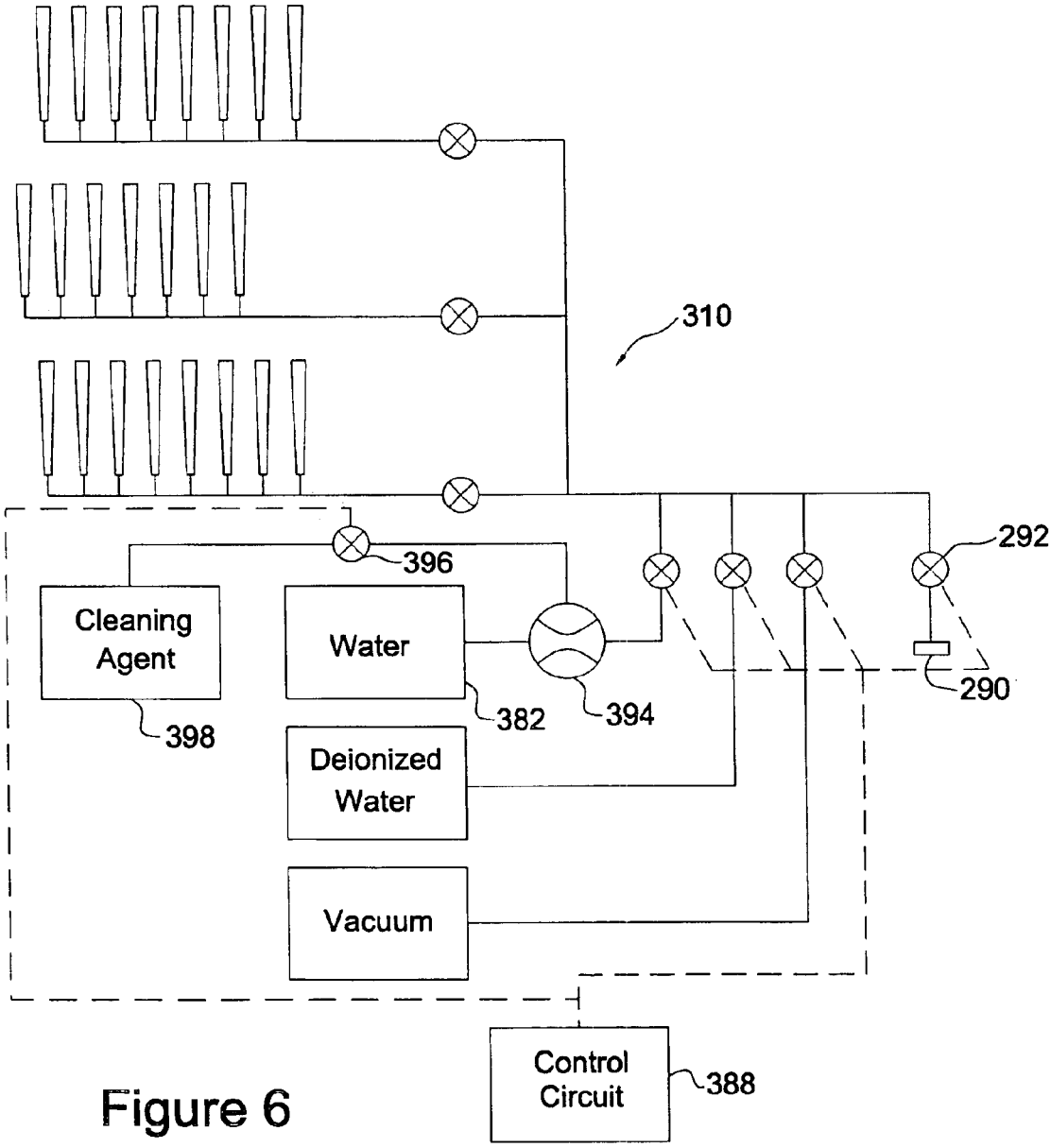
FIG. 6 is a schematic diagram of still another alternative embodiment of the inventive pipette washer.

FIG. 6 illustrates still another refinement of an alternative inventive pipette washer 310. Washer 310 is identical in structure and function to washer 210, except for the addition of a metering device 394, which upon the opening of valve 396 by control circuit 388, acts to meter in a quantity of a cleaning agent or agents from a cleaning agent reservoir 398. In accordance with the invention, it is contemplated that water source 382 will mix with cleaning agent from reservoir 398. For a time to clean the pipettes, after which control circuit 388 will close valve 396 causing the rinsing of the pipettes and the removal of the cleaning agent, followed by rinsing with de-ionized water, and the application of a vacuum after draining has been accomplished, as described above. In accordance with the invention, various cleaning agents may be used, depending upon the material which one wishes to clean from the pipette. Suitable materials are detergents, surfactants, alcohols, and so forth. Likewise, in accordance with the invention, other liquids other than water or de-ionized water may be used to clean pipettes. For example, the first reservoir to be activated may include alcohol, or a mixture of soapy water, or even a material such as acetone, or any other material which would achieve the desired cleaning operation.

In addition, in accordance with the preferred embodiment of the invention, the roof panel of the inventive pipette washer may include a number of icicle-shaped extensions which protrude down from the inside of the top or roof panel and are positioned to guide water by dripping the water onto particular areas of the pipette cell supporting rack.

While an illustrative embodiment of the invention has been described, it is, of course, understood that various modifications will be obvious to those of ordinary skill in the art. Such modifications are within the spirit and scope of the invention which is limited and defined only by the appended claims.

What is claimed is:

1. A pipette washer for washing pipettes having a wide top and a narrow tip, comprising:

(a) a plurality of cells for receiving pipettes, each of said cells comprising a top opening for receiving pipettes to be washed and a bottom opening, wherein said bottom opening is smaller than the top of said pipette;

(b) a support member for supporting said cells with said top openings oriented to receive pipettes to be washed;

(c) a plurality of manifolds communicating with a group of said cells;

(d) a hose system coupled to said bottom openings on said cells, said hose system being releasably connected to said plurality of manifolds communicating with a group of said cells, wherein said cells are organized into gangs, whereby each of the cells in each of said gangs is connectable as a group to said supply hose; and (e) a supply hose connected to said hose system.

2. A pipette washer as in claim 1, further comprising a metering device for adding a quantity of a cleanser material to a fluid being supplied through said supply hose.

3. A pipette washer as in claim 1, further comprising a fluidic switch having a plurality of inputs and an output, said output being coupled to said supply hose.

4. A pipette washer as in claim 3, wherein a vacuum is connected to one of said fluidic switch inputs.

5. A pipette washer as claimed in claim 4 wherein said cell member is conical in shape.

6. A pipette washer as in claim 3, wherein said fluidic switch is a valve.

7. A pipette washer as in claim 1, further comprising a housing for containing said plurality of cells and said support member, said housing defining an open front for the convenient loading of pipettes to be cleaned and the convenient removal of cleaned pipettes.

8. A pipette washer as in claim 7, wherein said housing comprises a roof for containing cleaning liquid and returning water to said pipettes to be cleaned.

9. A pipette washer as in claim 7, wherein said housing comprises a roof for containing cleaning liquid and guiding water to said pipettes to be cleaned.

10. A pipette washer as in claim 9, wherein each of said cells is supported in said support member with an orientation extending transverse to the horizontal, each of said support cells comprising a cell member having a top width and a bottom width, said width being wider at the top and narrower at the bottom.

11. A pipette washer as in claim 1, wherein said fluidic switch is controlled by a control circuit.

12. A pipette washer for washing pipettes having a wide top and a narrow tip, comprising:

(a) a plurality of cells for receiving pipettes, each of said cells comprising a top opening for receiving pipettes to be washed and a bottom opening, wherein said bottom opening is smaller than the top of said pipette;

(b) a support member for supporting said cells with said top openings oriented to receive pipettes to be washed;

(c) a hose system coupled to said bottom openings on said cells;

(d) a supply hose connected to said hose system; and (e) a fluidic switch having a plurality of inputs and an output, said output being coupled to said supply hose, wherein said fluidic switch is connected to a source of washing fluid and a vacuum, and wherein said fluidic switch is connected to allow washing fluid to the supplied to said supply hose for a first period of time, said fluidic switch having a position which allows for the draining of washing fluid during a second period of time, said second period of time being after said first period of time, said fluidic switch, after said second period of time configurable to take another position where said fluidic switch is coupled to said vacuum to allow for the drying of pipettes in said cells.

13. A pipette washer as in claim 12, wherein each of said cells is supported in said support member with an orientation extending transverse to the horizontal, each of said support cells comprising a cell member having a top width and a bottom width, said width being wider at the top and narrower at the bottom.

14. A pipette washer as in claim 13, wherein said cell member is conical in shape.

15. A pipette washer for washing pipettes, optionally pipettes having a wide top and a narrow tip, with a washing fluid, the pipette washer comprising a support member for supporting the pipettes and a hose system to supply the washing fluid to the pipettes wherein the support member comprises a plurality of cells for receiving pipettes, each said cell having a top opening for receiving pipettes to be washed and a bottom opening wherein the support member can support the cells with the top openings accessible to receive pipettes to be washed and wherein the hose system is coupled to the cell bottom openings to supply the washing fluid upwardly to the cells and upwardly into the pipettes received in the cells, wherein each of said cells is supported in said support member with an orientation extending transverse to the horizontal, each of said support cells comprising a cell member having a top width and a bottom width, said top width being greater than the bottom width, a fluidic switch having a plurality of inputs and an output, said output being coupled to said supply hose, wherein said fluidic switch is connected to a source of washing fluid and a vacuum wherein said fluid switch is controlled by a control circuit which causes, washing fluid to be supplied to said supply hose for a first period of time, said control circuit causing said fluidic switch to take a position which allows for the draining of washing fluid during a second period of time, said second period of time being after said first period of time, said control circuit causing said fluidic switch after said second period of time to take another position where said fluid switch is coupled to said vacuum to allow for the drying of pipettes in said cells.

16. A pipette washer as claimed in claim 15, further comprising a metering device for adding a quantity of a cleanser material to the washing fluid.

17. A pipette washer as claimed in claim 15, wherein said cells are organized into gangs, each of said gangs being connectable as a group to said supply hose.

18. A pipette washer for washing pipettes as in claim 17, wherein said gangs are color-coded.

19. A pipette washer as claimed in claim 15, wherein said housing comprises a roof for containing cleaning liquid and returning or guiding water to said pipettes to be cleaned.

20. A pipette washer for washing pipettes, optionally pipettes having a wide top and a narrow tip, with a washing fluid, the pipette washer comprising a support member for supporting the pipettes and a hose system to supply the washing fluid to the pipettes wherein the support member comprises a plurality of cells for receiving pipettes, each said cell having a top opening for receiving pipettes to be washed and a bottom opening wherein the support member can support the cells with the top openings accessible to receive pipettes to be washed and wherein the hose system is coupled to the cell bottom openings to supply the washing fluid upwardly to the cells and upwardly into the pipettes received in the cells, wherein each of said cells is supported in said support member with an orientation extending transverse to the horizontal, each of said support cells comprising a cell member having a top width and a bottom width, said top width being greater than the bottom width, further comprising a housing for containing said plurality of cells and said support member, said housing defining an open front for the convenient loading of pipettes to be cleaned and the convenient removal of cleaned pipettes, and a fluidic switch having a plurality of inputs and an output, said output being coupled to said supply hose and in that said fluidic switch is connected to a source of washing fluid and a vacuum, and wherein said fluid switch is controlled by a control circuit which causes washing fluid to the supplied to said supply hose for a first period of time, said control circuit causing said fluidic switch to take a position which allows for the draining of washing fluid during a second period of time, said second period of time being after said first period of time, said control circuit causing said fluidic switch after said second period of time to take another position where said fluid switch is coupled to said vacuum to allow for the drying of pipettes in said cells.

21. A pipette washer as claimed in claim 20, further comprising a metering device for adding a quantity of a cleanser material to a fluid being supplied through said supply hose.

* * * * *